US008662814B1

(12) United States Patent
McInnis

(10) Patent No.: US 8,662,814 B1
(45) Date of Patent: Mar. 4, 2014

(54) TRANSMISSION LIFT ARM

(76) Inventor: Russell Keith McInnis, Norfolk, VA (US)

( * ) Notice: Subject to any disclaimer, the term of this patent is extended or adjusted under 35 U.S.C. 154(b) by 779 days.

(21) Appl. No.: 12/925,290

(22) Filed: Oct. 18, 2010

(51) Int. Cl.
*B66F 9/18* (2006.01)

(52) U.S. Cl.
USPC ..... 414/607; 294/92

(58) Field of Classification Search
USPC ..... 414/607, 785; 294/92; 248/201, 218.4, 248/219.3, 219.4; 29/244, 252
See application file for complete search history.

(56) References Cited

U.S. PATENT DOCUMENTS

| | | | | | |
|---|---|---|---|---|---|
| 669,082 | A | * | 3/1901 | Gruenhagen | 29/244 |
| 1,026,548 | A | * | 5/1912 | Allien | 29/252 |
| 1,569,660 | A | * | 1/1926 | Massey | 220/285 |
| 1,856,621 | A | * | 5/1932 | Coffey | 29/763 |
| 2,490,772 | A | * | 12/1949 | Benner | 414/607 |
| 2,523,734 | A | | 9/1950 | Stephenson et al. | |
| 2,675,139 | A | * | 4/1954 | Mercier et al. | 414/607 |
| 2,819,113 | A | * | 1/1958 | Phillips | 294/87.1 |
| 2,967,730 | A | * | 1/1961 | Vann | 294/62 |
| 3,087,236 | A | * | 4/1963 | Paytas | 29/244 |
| 3,690,492 | A | * | 9/1972 | Shore | 414/607 |
| 3,700,132 | A | | 10/1972 | Waters | |
| 3,718,228 | A | * | 2/1973 | Lund et al. | 414/785 |
| 5,071,183 | A | | 12/1991 | McDermott et al. | |
| 5,303,966 | A | | 4/1994 | Robinson | |
| 5,352,056 | A | | 10/1994 | Chandler | |
| 5,695,230 | A | * | 12/1997 | Thompson | 294/15 |
| 5,732,991 | A | | 3/1998 | Tsui | |
| 5,887,922 | A | | 3/1999 | Hendrix et al. | |
| 6,766,991 | B1 | | 7/2004 | Nance et al. | |
| 6,768,474 | B2 | * | 7/2004 | Hunt | 343/892 |
| 7,020,943 | B2 | | 4/2006 | Cronk | |
| 8,522,412 | B1 | * | 9/2013 | Walker | 29/255 |
| 2004/0108738 | A1 | | 6/2004 | Marry | |

* cited by examiner

*Primary Examiner* — Joshua Rudawitz
(74) *Attorney, Agent, or Firm* — David L. Banner

(57) ABSTRACT

A transmission lift arm to facilitate the safe lifting and/or lowering of a transmission from or into a transmission jack. The transmission lift arm is provided in pairs and each is adapted for attachment to a transmission bell housing utilizing threaded rods secured thereto. The lift arms may be adjustably spaced apart on the lift arm of a lift truck to accommodate various spacings is the bell housing holes into which the threaded rods are placed and secured. The transmission arms may also be provided in a variety of sizes to mount to different lift bar sizes and/or to have different size threaded rods to accommodate a wide range of motor vehicle transmissions. In alternate embodiments, transmission lift arms having an adjustable opening may be used to accommodate different lift bar dimensions.

10 Claims, 6 Drawing Sheets

TRANSMISSION LIFT ARM

FIELD OF THE INVENTION

The invention pertains to apparatus adapted for lifting heavy, specialized objects and, more particularly, to a device for attachment to the bell housing of a motor vehicle transmission to allow safe lifting thereof using a lift truck.

BACKGROUND OF THE INVENTION

In motor vehicle repair shops, one task often performed is the repair or replacement of a vehicle's transmission. The transmission is typically both heavy and awkward to lift. Typically an overhead hoist or winch is used to lift a transmission using chains or other lifting straps placed around the transmission body. However, in some repair shops called upon to remove a transmission from a vehicle, such a hoist is unavailable.

When no hoist is available, a hydraulic transmission jack is at times used to lower a transmission from the vehicle that may be raised above the floor on a lift. This is an intricate procedure because transmission jacks rarely interface well with the body of a typical transmission and the transmission is often balanced precariously on the jack. Transmissions typically have components such as control arms protruding from their bodies—components that could easily be damaged if the transmission were to fall off the jack. In addition, typical hydraulic floor jacks are prone to rolling on the floor and must be stabilized, typically by a person.

To remove (or install) a transmission typically requires at least three persons to safely accomplish the removal or installation. Three people may not be available when it is time to remove or install a transmission so a repair job may be stalled until additional help is available. Even if other mechanics are available, they must typically be pulled from whatever repair job they are performing thereby extending the time required to complete those jobs. Finally, because of the shape and weight of a typical motor vehicle transmission, raising or lowering the transmission imposes less than ideal body mechanics on the mechanic or other person involved. This situation often leads to back strain or other back injuries.

DISCUSSION OF THE RELATED ART

Several attempts to provide apparatus and method for removing and installing motor vehicle transmissions may be found in the prior art. For example, U.S. Pat. No. 2,523,734 for TRANSMISSION GRIPPING DEVICE, issued Sep. 26, 1950 to John O. Stephenson et al. shows an apparatus for use with a floor jack to grip and stabilize the body of a transmission.

U.S. Pat. No. 3,700,132 for FLOOR HOIST, issued Oct. 24, 1972 to James R. Waters teaches a low profile portable hydraulic hoist for handling heavy structures in cramped quarters. The WATERS hoist is not specifically adapted to motor vehicle transmissions.

U.S. Pat. No. 5,071,183 for TOOL FOR INSTALLING CUTTING BLADES ON GRADERS, issued Dec. 10, 1991 to Jerry L. McDermott et al. provides a tool for temporarily supporting a cutting blade in a correct angular orientation to facilitate its installation on a grader.

U.S. Pat. No. 5,303,966 for TORQUE CONVERTER RETAINING TRANSMISSION TRANSPORT DEVICE, issued Apr. 19, 1994 to Larry M. Robinson teaches a device for retaining a torque converter within a bell housing, the device being attachable to a transmission and providing at least one handle to facilitate carrying a transmission.

U.S. Pat. No. 5,352,056 for HOIST RING WITH SELF-LOCK RETAINING RING, issued Oct. 4, 1994 to William M. Chandler shows hoist ring having a central screw having a head at a first end and a threaded shank at an opposite end.

U.S. Pat. No. 5,732,991 for CAST ARTIFACT HANDLING ASSEMBLY, issued Mar. 31, 1998 to Gary Tsui provides a safety hoist ring removably attachable to an anchor embedded in a concrete structure.

U.S. Pat. No. 5,887,922 for ADJUSTABLE LIFTING BAIL FOR FLUID COMPRESSOR, issued Mar. 30, 1999 to Dean P. Hendrix et al. teaches a lifting bail adapted to be made integral with a machine having a center of gravity and having a lift eye plate adjustably placeable near the center of gravity.

United States Published Patent Application No. 2004/0108738 for FORKLIFT CLAMP AND CHOKER SOFTENER, published Jun. 10, 2004 upon application by Marvin C. Marry provides a sleeve for placement on the fork of a lift truck to support and protect a sling for moving odd-shaped or heavy objects.

U.S. Pat. No. 6,766,991 for DRY SUMP PUMP BRACKET, issued Jul. 27, 2004 to Derek Nance et al. teaches a bracket mountable on the transmission on a race car for supporting a sump oiling pump.

U.S. Pat. No. 7,020,943 for LIFT TOOL, issued Apr. 4, 2006 to David W. Cronk provides a lift tool useful for installing a clutch assembly or flywheel into a vehicle bell housing.

None of these patents or the published patent application, taken singly, or in any combination are seen to teach or suggest the novel transmission lift arm of the present invention.

SUMMARY OF THE INVENTION

In accordance with the present invention there is provided a transmission lift arm to facilitate the safe removal and/or installation of a motor vehicle transmission from or to a transmission jack. The novel transmission lift arm is provided in pairs and each is adapted for removable attachment to the transmission utilizing threaded rods placed through preexisting holes in the bell housing portion of the transmission. The lift arms may be secured to the bell housing, typically using washers and nuts. The lift arms may be adjustably spaced apart on the lift arm of lift truck to accommodate various spacings in the bell housing holes into which the threaded rods are placed and secured. The transmission arms may also be provided in a variety of sizes to mount to different lift bar sizes and/or to have different size threaded rods to accommodate a wide range of motor vehicle transmission. In alternate embodiments, transmission lift arms having an adjustable opening may be used to accommodate different lift bar dimensions.

The novel transmission lift arms of the invention allow a single person to safely lift and/or lower a transmission while minimizing the possibility of damage to the transmission and injury to the mechanic removing or installing the transmission.

It is, therefore, an object of the invention to provide a transmission lift arm to facilitate lifting and lowering a motor vehicle transmission from or onto a transmission jack.

It is another object of the invention to provide a transmission lift arm that may be removably attached to the bell housing of the transmission being removed or installed.

It is an additional object of the invention to provide a transmission lift arm that has a threaded rod adapted for insertion into and retention within a hole in a bell housing of the transmission being removed or installed.

It is a further object of the invention to provide a transmission lift arm that is sized and configured for removable installation onto the lift bar of a lift apparatus.

It is a still further object of the invention to provide transmission lift arms in pairs, each one of the pair of transmission lift arms being attached to opposing ones of the bell housing holes and slidably spaced apart on the lift bar of the lift apparatus.

It is yet another object of the invention to provide a transmission lift arm that is strong enough to support the weight of a transmission and inexpensive to manufacture.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides an adapter for temporarily securing a bell housing or similar structure, typically of a motor vehicle transmission or the like to a lift bar of a lift truck or similar device. The novel transmission lift arm allows the safe lifting or lowering a transmission onto or from a conventional transmission jack by a single mechanic.

Figure 1:
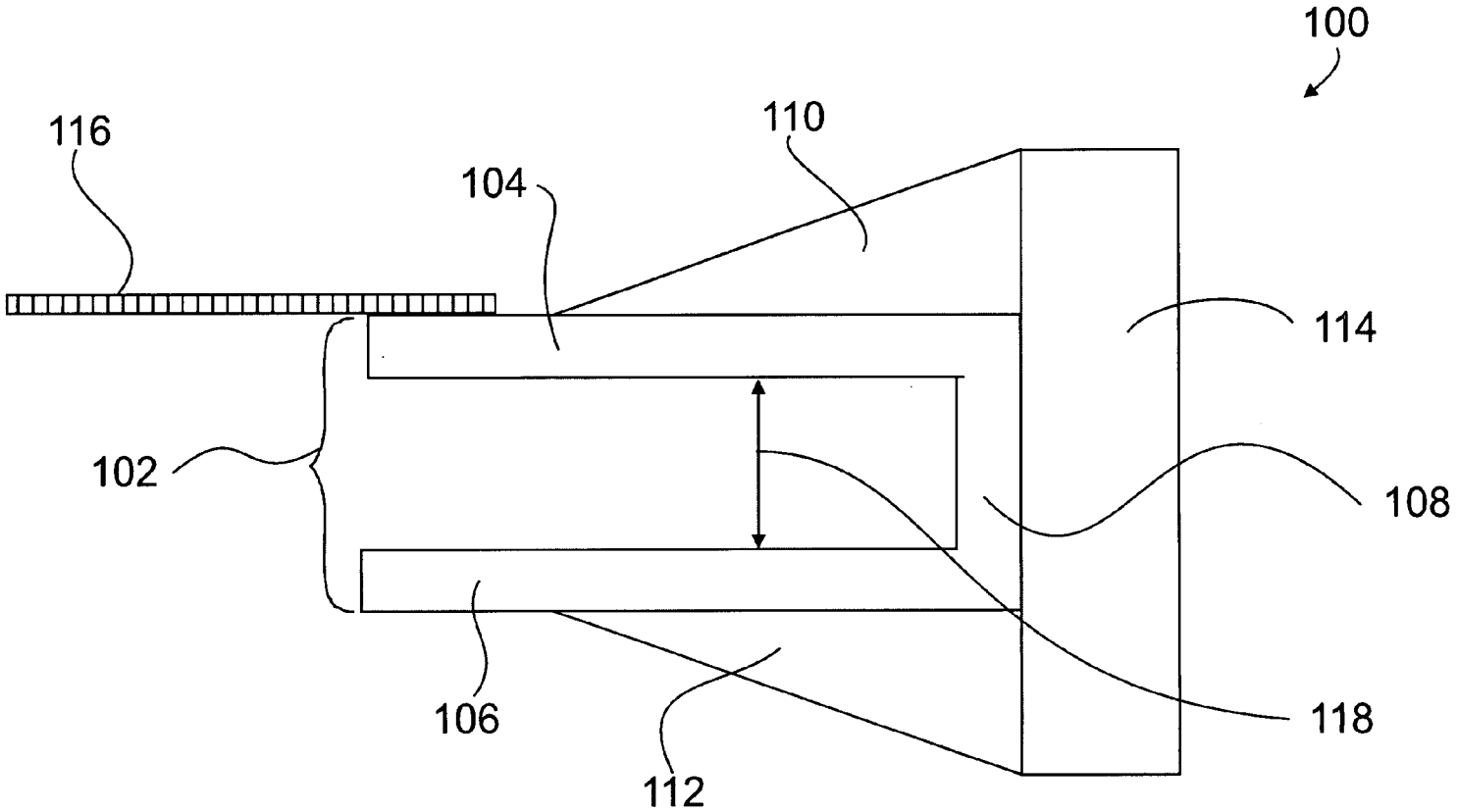
FIG. 1 is a side elevational, schematic view of one embodiment of a transmission lift arm in accordance with the invention.
Figure 2:
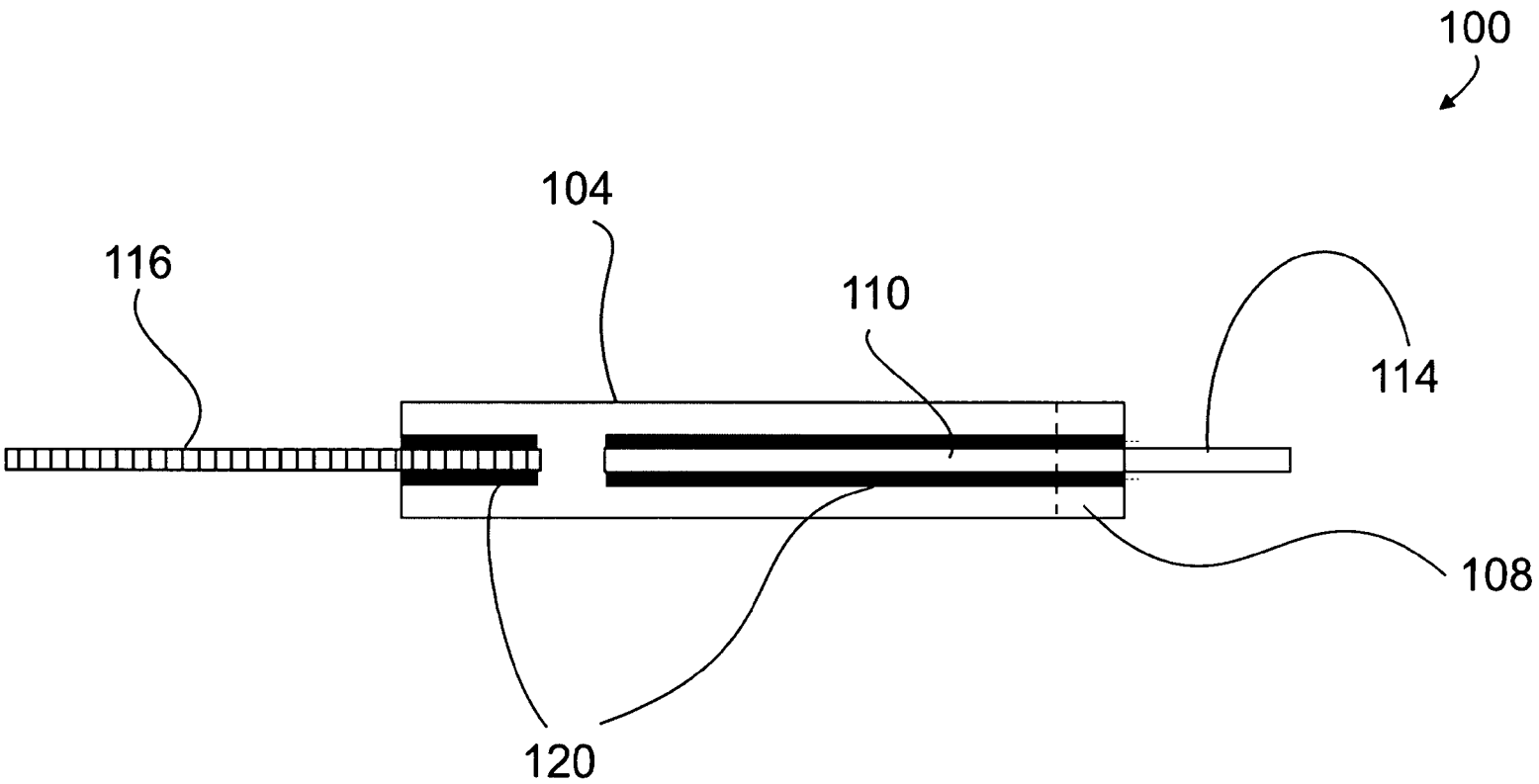
FIG. 2 is a top plan, schematic view of the transmission lift arm of FIG. 1.
Figure 3:
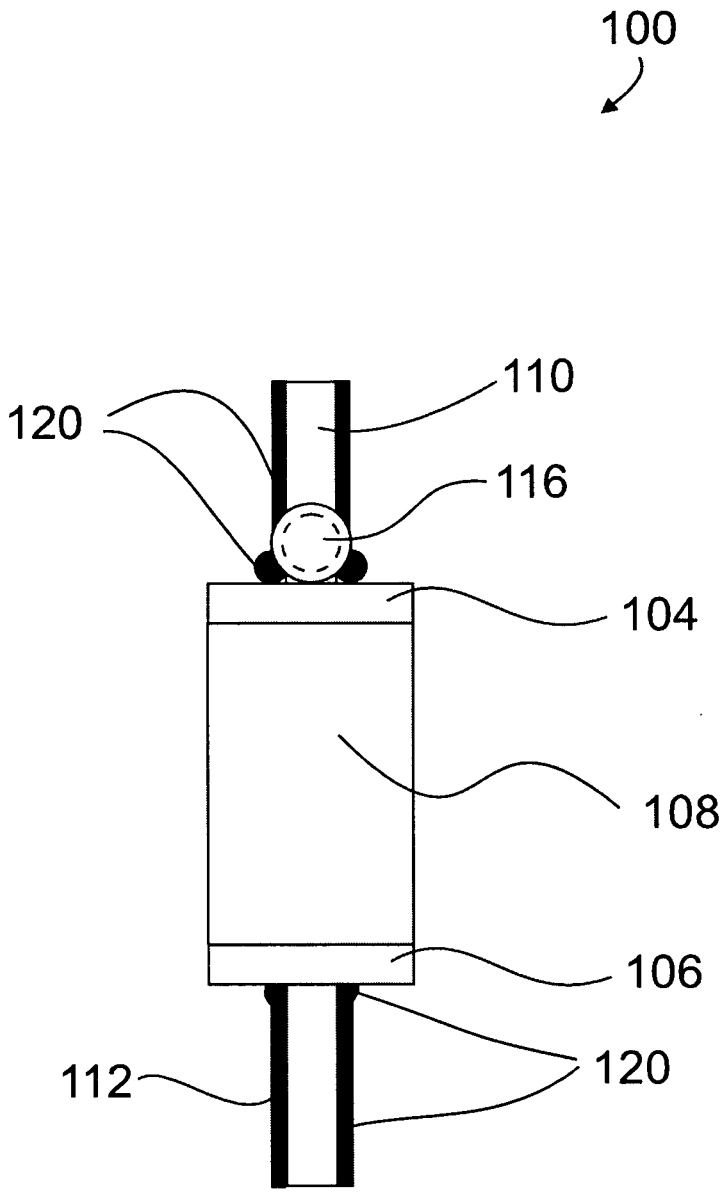
FIG. 3 is a front elevational, schematic view of the transmission lift arm of FIG. 1.

Referring first to FIGS. 1, 2 and 3, there are shown side elevational, top plan, and front elevational schematic views, respectively, of one embodiment of a transmission lift arm in accordance with the invention, generally at reference number 100.

Transmission lift arm 100 consists of a U-shaped member 102 consisting of an upper leg 104, a lower leg 106, and a spine 108 that is typically formed from a flat web of steel or another suitable material.

A pair of triangular braces, upper brace 110 and lower brace 112 and a vertical stiffener 114 are fastened to U-shaped member 102 by welding shown schematically at reference number 120. It will be recognized that fastening processes other than welding may be known to those of skill in the art and any suitable fastening process may be substituted for welding. The invention is, therefore, not limited to the welding fastening process chosen for purposes of disclosure. Rather the invention includes any suitable fastening process or material.

A projecting member 116 is attached to upper leg 104, typically by welding 120. Projecting member 116 is typically a threaded rod adapted to receive a nut or similar fastener, neither shown, on a distal end thereof. It will be recognized that projecting member 116 may be formed from a non-thread bearing rod. Consequently, the invention is not considered limited to the threaded rod chosen for purposes of disclosure.

Upper leg 104 and lower leg 106 are spaced apart by a distance 118 chosen to accept a particular dimension of a lift bar, not shown, of a lift truck with which lift arm assembly 100 will be used as discussed in detail hereinbelow.

The transmission lift arm 100 is adapted to mount on a single size lift arm, not shown, having a height substantially equal to distance 118. In a particular shop, more than one lift truck may be present, different lift trucks having different size lift arms. This situation results in sets of transmission lift arms 100 in different sizes being required to accommodate the different lift arm sizes. This problem may also be overcome by providing an adjustable transmission lift arm.

Figure 6A:
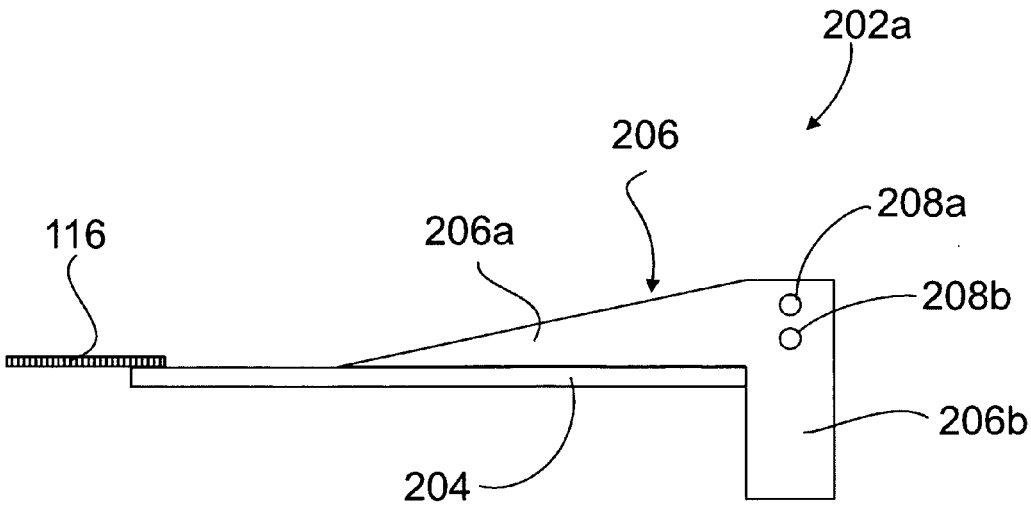
FIG. 6*a* is a side elevational view of a leg component of an adjustable transmission lift arm assembly.
Figure 6B:
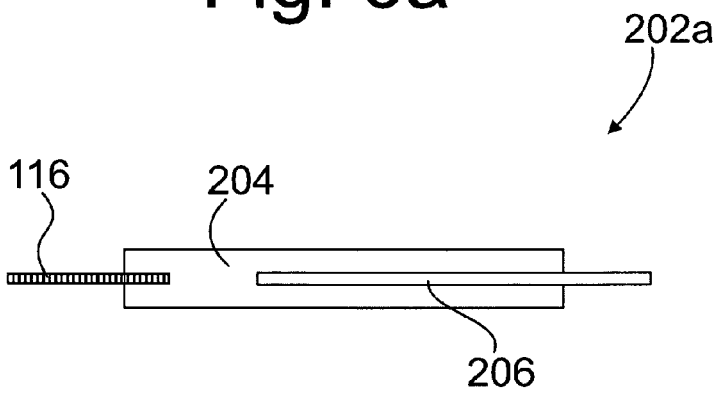
FIG. 6*b* a top plan view of a leg component of the adjustable transmission lift arm of FIG. 6*a;*
Figure 6D:
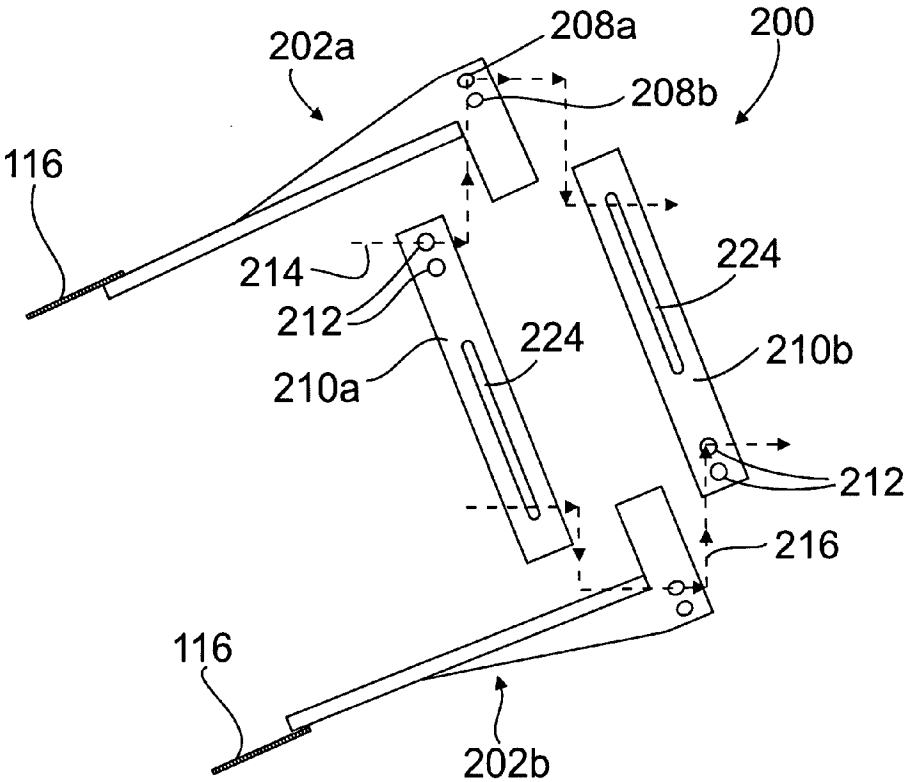
FIG. 6*d* is an exploded, perspective, schematic view of an alternate embodiment of the adjustable transmission lift arm in accordance with the invention.
Figure 6C:
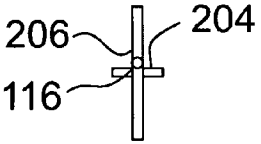
FIG. 6*c* is a front elevational view of the leg component of FIG. 6*a;*

Referring now also to FIGS. 6*a*, 6*b*, and 6*c*, there are shown side elevational, top plan, end front elevational views, respectively of a leg component 202 that may be used to form an adjustable lift assembly 200 (FIG. 6*d*). Leg component 202 consists of a flat, rectangular, horizontal member 204 and a vertical member 206 having a rectangular region 206*a* and a contiguous substantially triangular portion 206*b*. It should be noted that in an alternate embodiment an outside upper corner of rectangular portion 206*a* may be rounded. Vertical member 206 is attached to a midpoint along a major axis of rectangular horizontal member 204. A pair of through holes 208*a*, 208*b* are formed proximate an upper end of vertical member 206.

Vertical member 206 is typically attached to flat, rectangular, horizontal member 204 along by welding, not shown. Vertical member 206 is arranged such that a major axis of rectangular portion 206*b* is perpendicular to a major axis of flat, rectangular, horizontal member 204.

A threaded rod 116, described in detail hereinabove, is affixed to an upper surface of flat, rectangular, horizontal member 204.

A lower edge of triangular portion 206*a* is aligned with and affixed to an upper surface of flat, rectangular, horizontal member 204.

A pair of leg components 202*a*, 202*b* is utilized to form an adjustable transmission lift arm 200. Leg components 202*a* and 202*b* are mirror images of one another. While only leg component 202*a* has been described in detail, leg component 202*b* is identical except for the reversed relationships of flat, rectangular, horizontal member 204, vertical member 206, and threaded rod 118.

Leg components 202*a*, 202*b* are adapted to be linked by connecting bars 210*a*, 210*b*. Connecting bars 210*a*, 210*b* are typically identical to one another. However, as discussed hereinbelow, opposite ends of adjustable connector bars 210*a*, 210*b* are connected to respective ones of leg components 202*a*, 202*b*.

Referring now also to FIG. 6*d*, there is shown an exploded, perspective, schematic view of an alternate embodiment of the transmission arm in accordance with the invention, generally at reference number 200. Transmission lift arm 200 has an adjustable throat (i.e., inside space between the leg components 202*a*, 202*b* to allow its use with different lift trucks having different size lift bars.

A pair of connecting bars 210*a*, 210*b* each having a proximal end and a distal end and pair of spaced apart through holes 212 are disposed along a major axis of each connecting bar 210*a*, 210*b* proximate their respective proximal ends. Each connecting bar 210*a*, 210*b* also has a central slot 224 extending along the major axis, each said slot beginning at a point beyond a lower one of the pair of spaced apart holes 212 and continuing along the major axis to a point near the distal end of each of said pair of connecting bars 210*a*, 210*b*. Spaced apart through holes 212 are configured for alignment with spaced apart holes 208*a*, 208*b* of leg components 202*a*, 202*b*.

Bolts, washers, and nuts, not shown, or similar fastening systems, not shown, believed to be well known to those of skill in the art may be used to assemble connecting bars 210*a*, 210*b* to respective leg components 202*a*, 202*b*. Arrow 214 shows the path of a bolt or similar fastener through connecting bar 210*a*, leg component 202*a*, and connecting bar 210*b*. Likewise, arrow 216 shows the path of a connecting bolt or the like through connecting bar 210*a*, leg component 202*b*, and connecting bar 210*b*. It should be noted that paths 214, 216 show only a single fastener path. Typically, two fasteners (one through each of the two spaced apart holes 212) are used at each of leg components 202*a*, 202*b* mating with respective ones of spaced apart holes 208*a*, 208*b*. This construction prevents possible rotation of connecting bars 210*a*, 210*b* with respect to either of leg components 202*a*, 202*b*.

It should be noted that the connector bars 210*a*, 210*b* are installed in an inverted relationship with respect to one another. This inverted relationship of connecting bars 210*a*, 210*b* with respect to one another helps maintain an aligned relationship between leg components 202*a*, 202*b* and avoids pinching as leg components 202*a*, 202*b* are moved toward or away from one another to adjust the space therebetween.

Figure 6E:
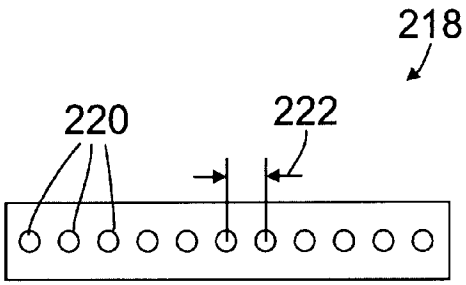
FIG. 6*e* is an alternate embodiment of a component of the adjustable transmission lift arm of FIG. 6

FIG. 6*e* shows an alternate embodiment of a connecting bar 218 suitable for use in implementing an adjustable transmission arm 200. Adjustable connecting bar 218 has a series of spaced apart holes 220 along a major axis thereof. The spacing 222 of holes 220 is chosen to match the spacing of spaced apart holes 208*a*, 208*b* in leg component assemblies 202*a*, 202*b*. Consequently, spaced apart holes 220 may readily be aligned with any two of spaced apart 208*a*, 208*b* to create a number of different, discrete spacings between leg components 202*a*, 202*b*.

Figure 4:
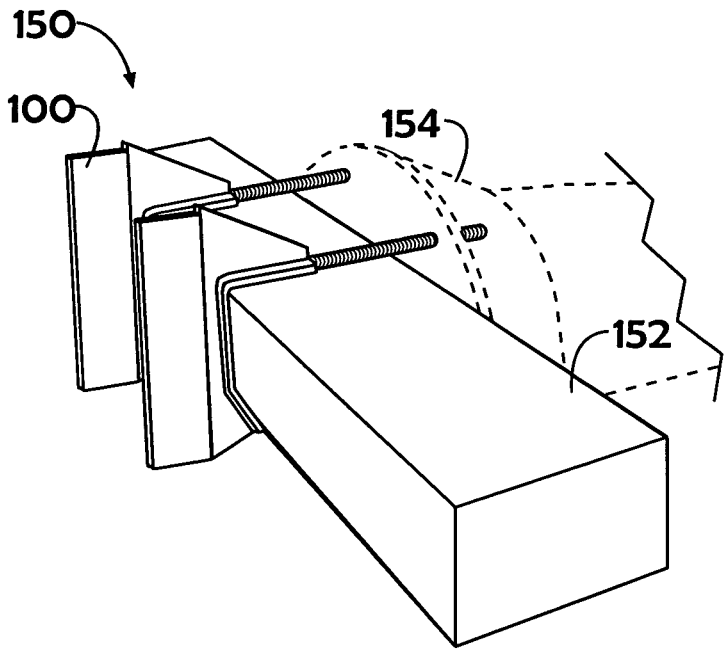
FIG. 4 is a side, perspective view of a pair of transmission lift arms of FIG. 1 in place on and supported by a lift bar of a lift truck and attached to a bell housing.
Figure 5:
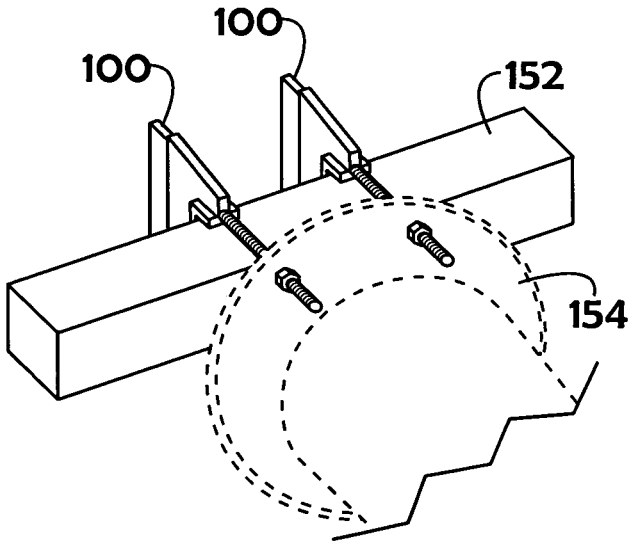
FIG. 5 is a rear, perspective view of a pair of transmission lift arms, a lift bar of a lift truck, and the bell housing of FIG. 4.

Referring now to also FIGS. 4 and 5 the use of transmission lift arms 100 or 200 of the invention is now described. FIG. 4 is a side, perspective view of a pair of transmission lift arms of the invention in place on and supported by a lift bar 152 of a lift truck, not shown, and attached to a typical bell housing 154, generally at reference number 150. FIG. 5 is a rear, perspective view of a pair of transmission lift arms, lift arm, and bell housing of FIG. 4. It should be noted that neither a lift truck, not shown, nor lift bar 152 forming a part thereof nor bell housing 154 form any part of the invention and are merely included to illustrate a typical operating environment for transmission lift arms 100 or 200.

In operation, a pair of transmission lift arms 100 is selected to match the height of the lift arm or bar 152 of the lift apparatus. Alternately, a pair of adjustable transmission lift arms 200 is each adjusted to match the height of lift bar 152. Transmission lift arms 100 or 200 are them disposed in a spaced apart relationship on lift arm 152. The space between a first one of a pair of transmission lift arms 100 or 200 and a second one of the pair of transmission lift arms 100 or 200 is chosen to correspond to the spacing between holes 156 in transmission bell housing 154.

Next, lift arm 152 carrying the pair of spaced apart transmission lift arms 100 or 200 is maneuvered so as to align threaded rods 116 with holes 156 in bell housing 154. Once aligned, threaded rods 116 are slid into and through holes 156 until their distal ends protrude on the other side of transmission bell housing 152. Once protruding, a washer, not shown, may be slid onto each of protruding threaded rods 116 and a nut, not shown, may be threaded onto each of protruding threaded rods 116. It is believed that nuts and washers are well known to those of skill in the art and are not further discussed herein. It will be recognized that chosen nuts and washers must be compatible with the diameter and/or thread configuration of threaded rods 116. The nuts, not shown, may be used to draw transmission bell housing 152 against transmission lift arm 100 or 200 and retain transmission bell housing 152 in that position.

Once secured, lift bar 152 may be manipulated to lift or lower transmission bell housing 152 as desired.

It will be recognized that while a transmission bell housing 152 has been chosen for purposes of disclosure, that the novel transmission lift arms 100, 200 may be adapted to interact with other items having a hole pattern that may be engaged by threaded rods 116. Consequently, the invention is not considered limited to transmission bell housings. Rather, the novel transmission lift arms and method may be used to raise or lower any other device having accessible holes to engage threaded rods 116 of transmission lift arms 100, 200.

The use of the novel transmission left arms 100 or 200 of the invention typically allows a single person to safely manipulate a transmission. Heretofore, two, often three persons were required to perform the same task and there were inherent safety risks associated with the lowering or raising operations.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A U-shaped transmission lift arm assembly, comprising:

a) a substantially rectangular, thin spine having an inward facing major surface and an opposing outward facing major surface;

b) a first flat, substantially rectangular elongated leg disposed substantially normally to and affixed to said inward facing surface of said thin spine;

c) a first triangular brace having a right angle with a short side having a first end adjacent said right angle and a long side normal thereto and having a first end adjacent said right angle, said short side being attached to said inward facing surface of said thin spine parallel to a major axis thereof with a second end of said short side disposed adjacent a first end of said thin spine, said long side being attached to an upper surface of said first flat, substantially rectangular elongated leg parallel to a major axis thereof, said long side being shorter than a length of said first flat, substantially rectangular elongated leg;

d) a second flat, substantially rectangular elongated leg disposed substantially normally to and also affixed to said inward facing surface of said thin spine;

e) a second triangular brace having a right angle with a short side having a first end adjacent said right angle and a long side normal thereto and having a first end adjacent said right angle, said short side being attached to said inward facing surface of said thin spine parallel a major axis thereof with a second end of said short side disposed adjacent a second end of said thin spine, said long side being attached to an lower surface of said second flat, substantially rectangular elongated leg parallel to a major axis thereof, said long side being shorter than a length of said second flat, substantially rectangular elongated leg; and f) rods attached to respective top and bottom surface of said first flat, substantially rectangular elongated leg and said second flat, substantially rectangular elongated leg, respectively, said rods being disposed substantially parallel to a respective major axis of said first and said second flat, substantially rectangular elongated leg, distal ends of said rods projecting beyond respective ends of said first and said second flat, substantially rectangular elongated legs opposite said thin spine; and a lower surface of said first flat, substantially rectangular elongated leg and an upper surface of said second flat, substantially rectangular elongated leg defining an opening sized to receive a lift arm therein.

2. The U-shaped transmission lift arm assembly as recited in claim 1, wherein at least one member selected from the group: said first flat, substantially rectangular elongated leg, said second flat, substantially rectangular leg, said first triangular brace, said second triangular brace said thin spine, and said rods is formed from steel.

3. The U-shaped transmission lift arm assembly as recited in claim 1, wherein at least one member selected from the group: said first flat, substantially rectangular elongated leg, said second flat, substantially rectangular leg, said first triangular brace, said second triangular brace said thin spine, and said rods is connected to at least one adjacent member selected from the group: said first flat, substantially rectangular elongated leg, said second flat, substantially rectangular leg, said first triangular brace, said second triangular brace said thin spine, and said rods by welding.

4. The U-shaped transmission lift arm assembly as recited in claim 1, wherein rods comprise threads formed on an exterior thereof adjacent said proximal ends thereof.

5. An adjustable transmission lift arm assembly, comprising:

a) a first leg component assembly, comprising:

i) a flat, substantially rectangular elongated member;

ii) a substantially flat vertical member having a rectangular portion contiguous with a triangular portion, said substantially flat vertical member being affixed an upper surface said flat, substantially rectangular elongated member along a midline of parallel to a major axis thereof, said substantially flat member being aligned with said flat, substantially rectangular elongated member such that a major axis of said rectangular portion is disposed substantially perpendicular to a major axis of said substantially rectangular elongated member, a lower edge of said triangular portion being aligned with an upper surface of said flat, substantially rectangular elongated member;

iii) a pair of spaced apart through holes disposed proximate an upper edge of said rectangular portion of said substantially flat vertical member;

b) a second leg component, said second leg component being formed as a mirror image of said first leg components but otherwise being identical thereto;

c) a pair of connecting bars, each having a proximal end and a distal end, each having a pair of spaced apart holes disposed along a major axis of each of said pair of connecting bars and proximate said proximal end, and a central slot extending along said major axis, said slot beginning at a point proximate a lower one of said pair of spaced apart holes and continuing along said major axis to a point proximate said distal end of each of said pair of connecting bars;

wherein said pair of spaced apart holes in each of said pair of connecting bars is sized and configured to align with said spaced apart holes in each of said first leg assembly and said second leg assembly.

6. The adjustable transmission lift arm assembly as recited in claim 5, wherein said spaced apart holes of a first of said pair of connecting bars is connected to said first leg component assembly and said slot of a second one of said pair of connecting bars is connected to an opposite said of said first leg component assembly, and slot of said first of said pair of connecting bars is connected to said second leg component assembly and said spaced apart holes of said second one of said pair of connecting bars is connected to an opposite side of said second leg component assembly.

7. A method of raising and lowering a component having a bell housing having through holes in an edge thereof, the steps comprising:

a) providing a pair of transmission lift arm assemblies as recited in claim 1;

b) placing each of said transmission lift arm assemblies on a lift bar of a lift truck at a predetermined spacing one from another;

c) maneuvering said lift truck so as to align threaded rods forming a portion of each of said lift arm assemblies with through holes in said bell housing of said component;

d) sliding distal ends of said threaded rods through respective ones of said through holes; and e) securing said bell housing to said pair of transmission lift arms by mating a fastener at said distal ends of said threaded rods.

8. The method of raising and lowering a component having a bell housing having through holes in an edge thereof as recited in claim 7, wherein said providing step (a) comprises selecting a pair of transmission lift arms having a spacing compatible with a height of said lift arm of said lift truck.

9. The method of raising and lowering a component having a bell housing having through holes in an edge thereof as recited in claim 7, wherein said providing step (a) comprises providing a pair of adjustable transmission lift arms and adjusting the spacing of said adjustable transmission lift arms to be compatible with a height of said lift arm of said lift truck.

10. The method of raising and lowering a component having a bell housing having through holes in an edge thereof as recited in claim 7, wherein said securing step (e) comprises mating at least one selected from the group: a nut, and a washer to said distal ends of said threaded rods.

* * * * *